US005955874A

United States Patent [19]

Zhou et al.

[11] Patent Number: 5,955,874

[45] Date of Patent: Sep. 21, 1999

[54] SUPPLY VOLTAGE-INDEPENDENT REFERENCE VOLTAGE CIRCUIT

[75] Inventors: Qimeng Zhou, Sunnyvale; Pau-Ling Chen, Sarratoga, both of Calif.

[73] Assignee: Advanced Micro Devices, Inc., Sunnyvale, Calif.

[21] Appl. No.: 08/265,583

[22] Filed: Jun. 23, 1994

[51] Int. Cl.[6] ..... G05F 3/02

[52] U.S. Cl. ..... 323/315; 327/542; 327/543

[58] Field of Search ..... 327/542, 543, 327/538; 323/315; 330/257, 288

[56] References Cited

U.S. PATENT DOCUMENTS 5,304,862 4/1994 Memida .

OTHER PUBLICATIONS

Paul R. Gray and Robert G. Meyer, 1977 Analysis and Design of Analog Integrated Circuits second edition Published simultaneously in Canada, 1977.

*Primary Examiner*—Peter S. Wong

*Assistant Examiner*—Aditya Krishnan

*Attorney, Agent, or Firm*—Benman Collins & Sawyer

[57] ABSTRACT

A reference voltage circuit is disclosed that is independent of the voltage supply as well as substantially insensitive to process and temperature variations. The reference voltage circuit includes an intrinsic transistor circuit which includes a plurality of intrinsic transistors of equal size. The intrinsic transistor circuit is coupled to a current mirror circuit, and a plurality of threshold transistors. In so doing, a reference voltage circuit is provided that is substantially independent of process and temperature variations. In addition, by grounding the source connections of the plurality of threshold transistors, the reference voltage circuit output voltage also is substantially independent of supply voltage variations.

9 Claims, 2 Drawing Sheets

SUPPLY VOLTAGE-INDEPENDENT REFERENCE VOLTAGE CIRCUIT

FIELD OF THE INVENTION

The present invention relates to a circuit for providing a reference voltage, and more particularly, to a reference voltage circuit which provides an output reference voltage which is independent of the supply voltage.

BACKGROUND OF THE INVENTION

Circuits for providing a reference voltage (hereinafter reference voltage circuits) are utilized in a variety of applications. It is also very important in many applications that the reference voltage ($V_{REF}$) be independent of the supply voltage ($V_{CC}$) and environmental conditions.

Such circuitry in need of voltage independence can be found in a myriad of specific and general electronic applications; especially in those circuits of many products wherein it is an absolute requirement to have a very stable voltage source which in turn can be used internally within the circuits power other sub-circuits.

For example, in the art of flash memory one may want to program (insert information) into one of the memory cells. In order to achieve this, one needs to construct an internal pump which acts to internally establish a particular program voltage level. Likewise, in the instance when you need to erase a particular memory cell a pump is also needed. This pumping action of a voltage has the inherent problem of varying substantially according to the $V_{CC}$ and the operating temperature of the circuit due to the varying temperature coefficients of the circuit components. These variations effect the circuits operating frequency characteristics. The requirement for the pump output, in order to be able to perform the erase on some memory cells, needs to stay relatively constant in order to have the same characteristics as the programming such that the erase operation is complete and effective.

To achieve this stable program/erase voltage, a very stable reference voltage $V_{REF}$ is required which is held to a constant level. For instance, if the reference voltage is at a level of, for example, two (2) volts and the erase/program requirements are such that only nine (9) volts are required then the pump must be sourcing a steady 9 volt supply. Otherwise depending on other parameters such as temperature and process variations, if any, the output of the pump may simply vary too much. In many cases, five (5) volt components need to be pumped to maintain specific predetermined signal margin levels which do not fluctuate beyond selected parameters.

Furthermore, there are other circuits, such as the power-on-reset circuit, which is a circuit having a characteristic such that it can effectively lockout a low $V_{CC}$, can make use of a very stable $V_{REF}$ also. In this instance, when the $V_{CC}$ or the supply voltage is too low it may affect the circuit operation. In these particular circuits, a stable $V_{REF}$ has a particular usage. Similarly, there are many other applications for a very stable $V_{REF}$ also such as in a DRAM design.

More particularly, in this art specific problems exist with establishing and maintaining proper bias conditions within the circuits which are independent of varying chip operating temperatures and differing supply voltage variations within the chip's many individual circuit components. In addition, additional problems are inherent in the manufacture of the chip wafer which may add process variations to the surface on which these many millions of components will be placed.

Because of the increasing complexity of the circuitry contained on a single integrated circuit (IC) chip, minimization of power dissipation is also of particular importance from a packaging perspective. Fluctuations in bias current with temperature, supply voltage, and process variations can often result in power dissipation problems which may impact the design objectives of the circuit. As such, supply-independent bias circuitry is particularly important in order to avoid the injection into the signal path of the various components of the IC-circuit spurious and deleterious high-frequency signals that may quite often be present on the power-supply lines. Critical in this regard is the ability to achieve a degree of supply voltage independence between the many circuits on the chip and the supply voltage source (s) made available to the various chip components such that the biasing circuits are referenced to some voltage potential other than that of the supply voltage.

The prior art, MOS (metal oxide semiconductor), includes the use of a threshold voltage, the use of the difference between the threshold voltages of dissimilar devices, the use of the base-emitter voltage of some parasitic bipolar transistor device, the use of the thermal voltage, and the use of the band-gap voltage. Furthermore, the use of self biasing in these circuits may dramatically improve supply independence. However, these approaches often require the implementation of a stand alone start-up circuit which, when activated upon power-on, helps prevent the circuit from reaching equilibrium in some state other than that state desired by the circuit designer to be optimal for tolerated circuit function.

In the instance wherein voltage supply independence is achieved by use of threshold-referenced biasing, in a $V_t$-referenced self-biased threshold-referenced circuit feedback is produced by transistors which forces the same current to flow in another transistor as that which flows through resistor. Here, temperature and supply dependence remains basically the same.

Another important aspect of the performance of this type of self-biased circuit is stability at the desired operating point. However, self-biased circuits often are very dependent on positive feedback. Thus, to maintain a fair degree of stability, it must be predetermined that the feedback loop gain is actually less than unity at the desired operating point by breaking the loop, injecting a signal therein, and ascertaining that the loop gain is less than unity.

Another important aspect of the performance of bias circuits is the degree of supply independence that can be achieved in the circuit's bias currents and voltage levels. In this particular instance, the channel-length modulation in the transistors may cause variations in the levels of bias current which to a fair degree may be minimized by the use of cascode current sources.

It is very important to note that these type voltage threshold-referenced bias circuits have inherent problems, in that, in most MOS processes the threshold voltage is not particularly well controlled, (a range of threshold voltages typically would be from 0.5 to 0.8 V). Another problem, albeit more tangentially, is that in these type circuits often the threshold voltage of an n-channel MOS transistor displays a relative negative temperature coefficient whereas diffused resistors quite often display a substantially positive temperature coefficient to the effect that the output current has a large negative temperature coefficient.

An alternative approach to threshold referencing is the use of the difference between the threshold voltages of two semiconductor devices having the same polarity but which also have differing channel implants such that the temperature coefficients of the two threshold voltages cancel to first order. However, one disadvantage of this type of implementation of a voltage reference is the large initial tolerance in the output voltage value because of the relatively high tolerance on the threshold voltages which must be dealt with. In these instances, the absolute output voltage can be effectively adjusted by trimming.

In the instance wherein voltage supply independence is achieved by use of Base-Emitter-referenced biasing (or $V_{BE}$,-referencing), a typical $V_{BE}$-referenced bias circuit includes a pnp-transistor as the parasitic device that is inherent in p-substrate CMOS technologies. Alternatively, a corresponding circuit utilizing npn-transistors can be implemented in n-substrate CMOS technologies. It should be noted that this particular biasing method is not available in NMOS technology because of the lack of a diode or transistor. This configuration of $V_{BE}$-referenced biasing has the advantage that the $V_{BE}$ of a bipolar transistor is a relatively well-controlled component characteristic typically having a variation of 5 percent of its value as a result of inherent processing variations.

However, the disadvantages are such that the $V_{BE}$ displays a negative temperature coefficient which when coupled with the strong positive temperature coefficient of the diffused and poly-silicon type resistors therein may result in a relatively highly negative temperature coefficient in the overall bias current of the circuit. Also and in the alternative as with the threshold-referenced type circuit, the variation of reference current with spurious power-supply fluctuations can be minimized by the use of cascode or Wilson current sources.

In the instance wherein voltage supply independence is achieved by use of Thermal Voltage ($V_t$)-referenced current sources, a $V_t$-referenced self-biased reference circuit wherein two transistors having areas that differ by a set factored amount and a feedback loop therein allows these two transistors to operate at the same bias current level such that the difference between the two Base-Emitter voltages ($V_{BE}$) is across resistor R. The primary advantage of this type circuit implementation is that the thermal voltage $V_t$ has a positive temperature coefficient and, when taken in conjunction with the positive temperature coefficient of the resistor, a relatively temperature-independent output current results.

However, it should be understood that in this type circuit, small differences in the gate-source voltages of components of such a circuit may result in relatively large fluctuations in the resulting output current level due, primarily to the fact that the voltage differential established across the resistor is relatively small (on the order of about 100 mV) caused from component mismatches. This may also result from channel-length modulation activity in the transistors due to their differing drain voltage potentials. Prior art implementations of this type circuit typically will often utilize relatively large device for the components in order to minimize gate-source voltage offsets therein and will often utilize cascode or Wilson current sources in order to minimize channel-length modulation effects.

All of the above-identified reference voltage circuits are process and temperature sensitive. Therefore some additional circuitry is necessary to counteract that temperature and process sensitivity. This additional circuitry increases the cost and complexity of the reference voltage circuit. What is needed is a voltage reference circuit that is supply voltage independent, while at the same time does not require the additional circuitry necessary for adjustment for the proper operation of prior independent reference voltage circuit. The present invention addresses such a need.

SUMMARY OF THE INVENTION

A supply voltage independent reference voltage circuit is disclosed that is substantially insensitive to power supply, process and temperature variations. In one aspect, the reference comprises a current mirror coupled to a voltage source, intrinsic transistor circuit coupled to the current mirror. The intrinsic transistor circuit includes a plurality of transistors, where each of the plurality of transistors are substantially the same size. The reference voltage circuit also includes a plurality of threshold voltage transistors coupled to the intrinsic transistors. Each of the plurality of threshold transistors are also substantially the same size. In another aspect, threshold voltage means is coupled to a ground potential to eliminate the body effect of the circuit. The reference voltage circuit provides an output voltage which is substantially independent of temperature and process variations.

Through the present invention a reference voltage circuit is provided that does not require a significant addition of circuitry and is relatively easy to implement. The reference voltage circuit of the present invention does not require the complex circuitry typically required to counteract the process and temperature variations.

DETAILED DESCRIPTION

The present invention relates to an improvement in a circuit for generating a reference voltage. The following description is presented to enable one of ordinary skill in the art to make and use the invention as provided in the context of a particular application and its requirements. Various modifications to the preferred embodiment will be readily apparent to those skilled in the art, and the generic principles defined here may be applied to other embodiments. Thus, the present invention is not intended to be limited to the embodiments shown, but is to be accorded the widest scope consistent with the principles and novel features disclosed herein.

Figure 1:
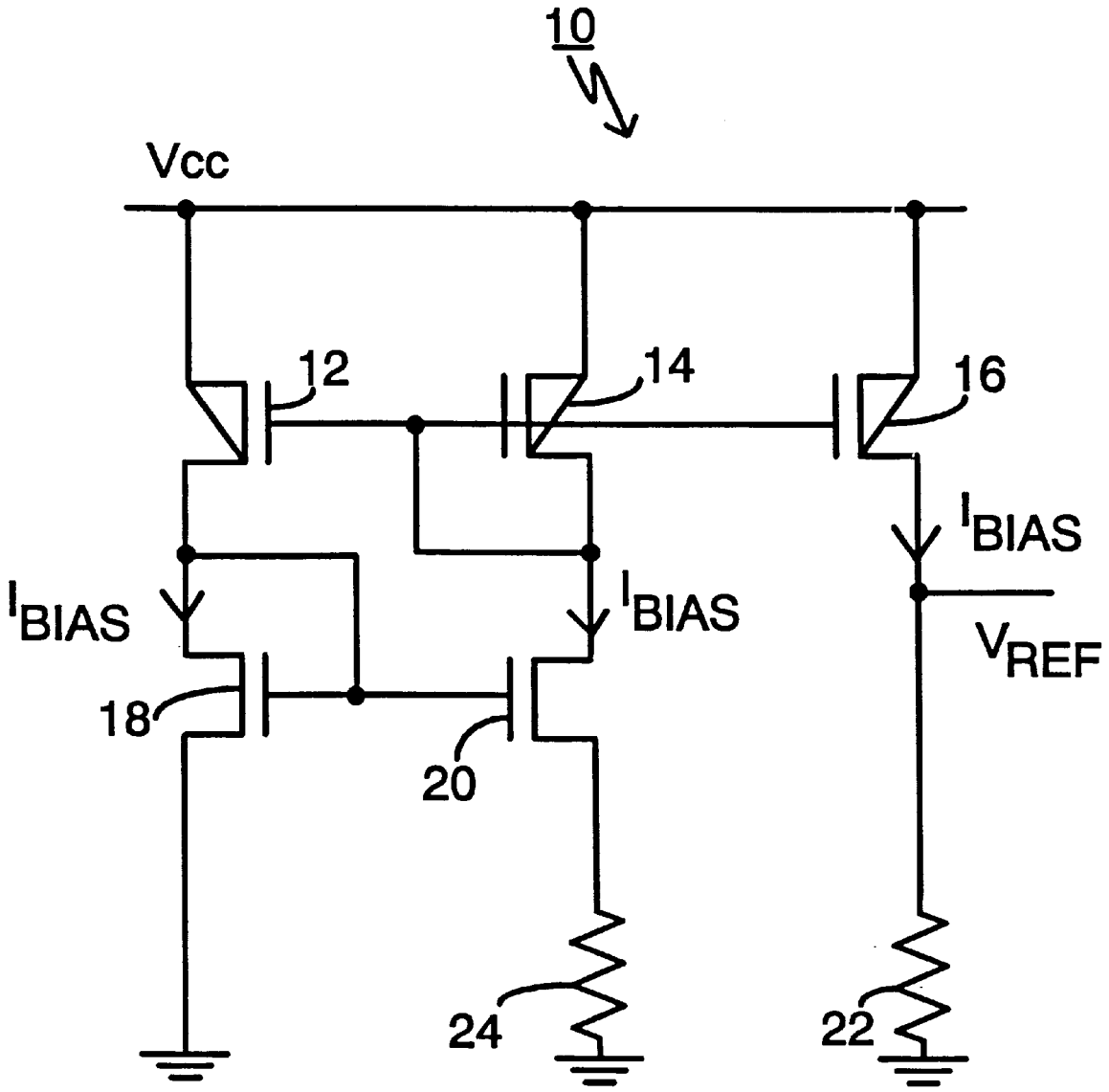
PRIOR ART FIG. 1
FIG. 1 is a schematic diagram of a conventional voltage referenced circuit.

FIG. 1 shows a diagram of a prior art CMOS voltage-reference circuit 10 to achieve supply voltage independence. The circuit 10 includes transistors 12 and 14, and output transistor 16. The sources of transistors 12, 14 and 16 are coupled to the supply voltage ($V_{CC}$) and their gates are coupled to each other. The gate of transistor 14 is also coupled to its drain. The drain of output transistor 16 is coupled to a resistor 22 which in turn is coupled to a ground potential.

The drains of transistors 18 and 20 are coupled to the drains of transistors 12 and 14, respectively. The source of transistor 18 is coupled to the ground potential. The source of transistor 20 is coupled to a resistor 24 which in turn is coupled to the ground potential. In this embodiment, the width to length (W/L) ratio of transistor 20 is greater than the W/L ratio of transistor 18.

With the three p-channel transistors, 12, 14, and 16 matched identically, they will each carry equal currents:

$$IBIAS=(VGS_{18}-VGS_{20})/R_{24}.$$

By choosing the W/L of transistor 20 to be greater than the W/L of transistor 18, IBIAS can then be calculated to be:

$$2/(Em*C_{OX}*R^2_{24})*[(W/L)^{-0.5}{}_{transistor\ 18}-(W/L)^{-0.5}{}_{transistor\ 20}]$$

and the reference voltage ($V_{REF}$) is equal to:

$$2/(Em*C_{OX})*(R_{22}/R^2_{24})*[(W/L)^{-0.5}{}_{transistor\ 18}-(W/L)^{-0.5}{}_{transistor\ 20}]$$

where;

Em—the average electron mobility in the channel of nmos transistor.

$C_{OX}$—the gate capacitance per unit area.

R22—the diffused or poly-silicon resistor value of resistor 22.

R24—the diffused or poly-silicon resistor value of resistor 24.

W/L—The effective ratio of channel width to channel length of the transistors.

The circuit parameters Em, $C_{OX}$, R22, R24, and W/L will now be described in terms of their temperature and process dependence.

Temperature Dependence

Em displays a negative temperature coefficient, while it is known that R22 and R24 display a positive temperature coefficient. The parameters $C_{OX}$ and W/L are essentially temperature independent. However, the product of Em, $R_{22}/R^2_{24}$ is temperature dependent. It has been found that these parameters do not track inherently, but vary independently with temperature and therefore do not cancel each other.

Process Dependence

All of the above-mentioned circuit parameters are inherently process-sensitive, therefore, the reference voltage circuit 10 is very process sensitive. In addition, this reference voltage circuit is highly susceptible to body-effect on the transistor 20. What is meant by body effect is a threshold voltage shift when there is a back bias between the source and the body or the bulk of the transistor. Since the source of the transistor 20 is not coupled to ground, while the body of the circuit is coupled to ground, the transistor has a back-bias effect. This back-bias will contribute a significant threshold voltage shift due to the temperature and process sensitivity, and ultimately effects the circuit voltage supply-independence.

What has been discovered is that through the use of the current mirror circuit within the voltage reference circuit and then coupling an intrinsic transistor circuit to the current mirror circuit, where the intrinsic transistor circuit includes a plurality of intrinsic transistors that are of substantially the same or equal in size the voltage provided at the respective nodes are equal. Thereby the intrinsic transistor circuit allows a differential voltage between the threshold transistors to be utilized to provide the reference voltage. Therefore, a reference voltage circuit is provided that is substantially independent of process and temperature variations.

In addition, the reference voltage circuit includes a plurality of threshold voltage transistors coupled to the intrinsic transistors in which each of the plurality of threshold transistors have a grounded source connection. The threshold transistors are substantially the same or equal in size. In so doing, the effect of the back-bias of the transistor is completely eliminated. Accordingly, this grounded source connection allows the voltage reference circuit to be substantially supply voltage independent.

Figure 2:
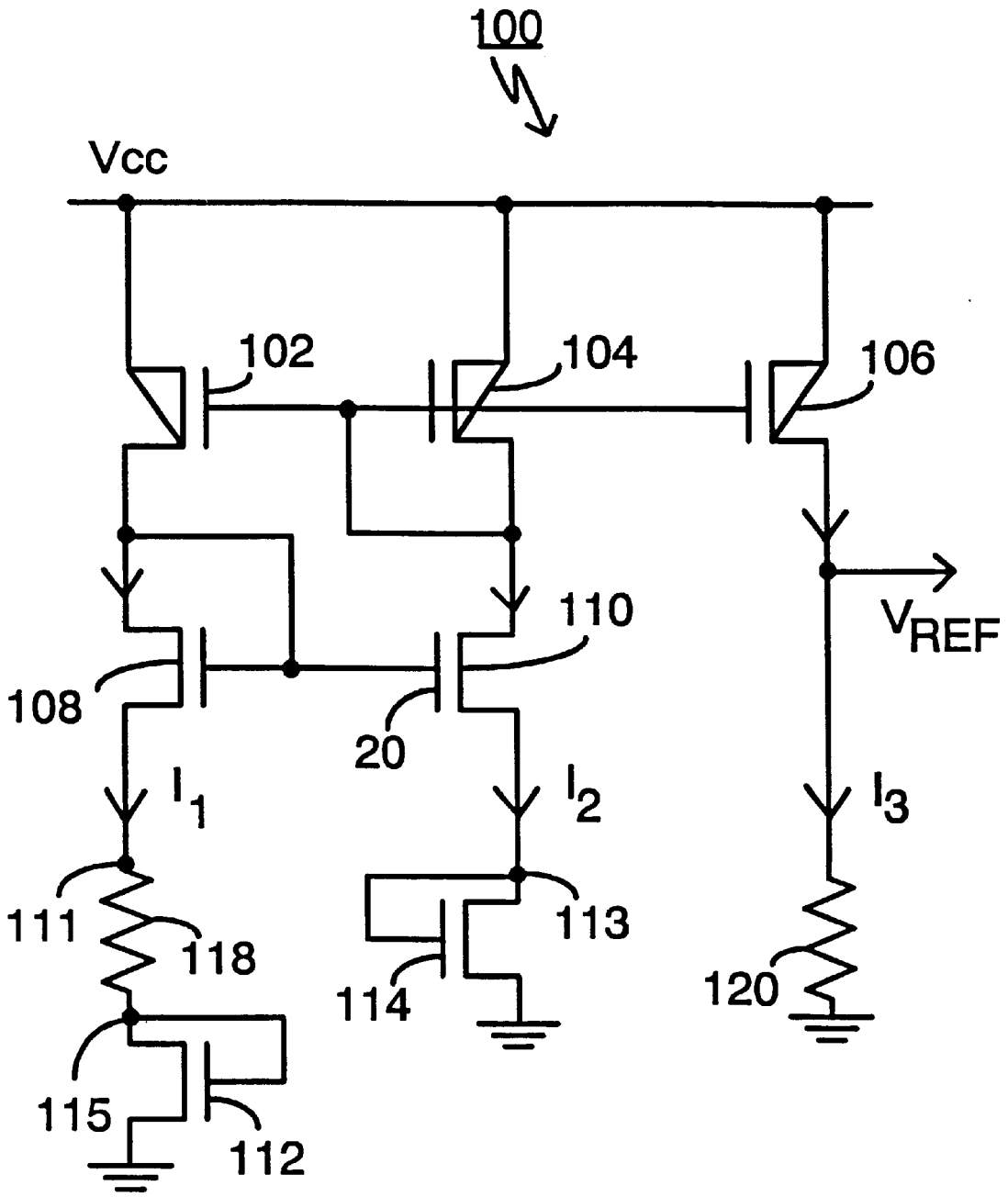
FIG. 2 is a schematic diagram of a voltage reference circuit in accordance with the present invention.

To more specifically describe the advantages of a voltage reference circuit in accordance with the present invention, refer now to FIG. 2. Voltage reference circuit 100 includes transistors 102, 104 and 106 which form a current mirror which is similar in form and operation to the current mirror of transistors 12, 14, and 16 of the prior art voltage reference circuit 10 of FIG. 1. Output transistor 106, similar to transistor 16 of FIG. 1 is coupled to a load resistor 120. Resistor 120, in turn, is coupled to a ground potential. The circuit 100 includes intrinsic transistors 108 and 110 which are of substantially equal size, and which drains are coupled to the drains of the transistors 102 and 104, respectively. The gates of transistors 108 and 110 are coupled together. The gate of transistor 110 is also coupled to its drain. The source of transistor 108 is coupled to a second resistor 118. The resistor 118 is coupled to a diode connected threshold voltage transistor 112 which source is coupled to a ground potential. The source of transistor 110 is coupled to a diode connected threshold transistor 114 which source is also in turn coupled to a ground potential. Transistors 112 and 114 are substantially equal in size.

In this circuit 100, p-MOS transistors 102, 104 and 106 form a current mirror circuit, therefore the current passing through each of the transistors 102, 104 and 106 ($I_1$, $I_2$ and $I_3$) is equal. The reference voltage ($V_{REF}$) is equal to I3*R120 through transistor 106. In the present invention, both intrinsic transistors 108 and 110 are sized equally and therefore the current through their legs are equal ($I_1=I_2$). Therefore, the voltages at node 111 and node 113, respectively, are equal. Assuming that the enhancement threshold-voltage of transistor 114 is Vte and the intrinsic threshold-voltage of transistor 112 is Vti then, the voltage differential across nodes 111 and 115 is equal to the threshold-voltage difference between threshold transistors 114 and 112 or [Vte−Vti].

Therefore, $$V_{REF} = I3 * R_L = I1 * R_L = [Vte - Vti] * (R120 / R118)$$

Furthermore, since the threshold voltages (Vte and Vti) track each other when temperature and supply voltage ($V_{CC}$) are changed, the differential voltage [Vte−Vti] is essentially a constant. In addition, the resistance is placed between the intrinsic transistor 108, and the threshold transistor 112, rather than between the threshold transistor and the ground potential as shown in the prior art (FIG. 1), wherein there is a constant ratio between resistor 120 and resistor 118. This constant ratio allows the voltage reference circuit to be insensitive to temperature and process variations. Finally, in a preferred embodiment, the values of resistors 118 and 120 are ratioed so as to provide a whole number.

In addition, in this preferred embodiment, the differential threshold transistors 112 and 114 have a grounded source connection, thus the reference voltage circuit 100 does not suffer output voltage variations due to the body-effect. The grounded source connection of the threshold transistors 112 and 114 allows the reference voltage circuit to be substantially less sensitive to voltage supply variation than previously known reference voltage circuits.

Accordingly, through the coupling of an intrinsic transistor section with the current mirror, which the intrinsic transistor section includes a plurality of intrinsic transistors, each of the transistors being substantially the same or of equal size, and each of the threshold transistors being substantially the same or of equal size, the output voltage of the voltage reference circuit is substantially independent of process and temperature variations. In addition by tying the source connections of the threshold transistors directly to ground the voltage reference circuit is substantially independent of supply voltage variations.

It should be readily recognized that although this present invention has been described in connection with a specific embodiment, that many modifications can be made and they would be within the spirit and scope of the present invention. For example, it should be recognized that any number of transistors in the various sections of the reference voltage circuit can be utilized, and that would be within the spirit and scope of the present invention. Similarly the resistors 118 and 120 could be of any size and their use would be within the spirit and scope of the present invention. Finally, it should be recognized that extrinsic threshold voltage of the threshold transistor can be any number as long as the difference between the two voltages is greater than zero.

Although the present invention has been described in accordance with the embodiments shown in the figures one of ordinary skill in the art will recognize there could be variations to those embodiments and those variations would be within the spirit and scope of the present invention. Accordingly, many modifications may be made by one of ordinary skill in the art without departing from the spirit and scope of the present invention, the scope of which is defined by the appended claims.

We claim:

1. A reference voltage circuit comprising:

a current mirror circuit means coupled to a voltage source;

the current mirror circuit means further including a first transistor coupled to the voltage source, a second transistor coupled to the first transistor and the voltage source, a third transistor coupled the first transistor, the second transistor and the voltage source, and a first resistance coupled between the third transistor and the ground potential;

intrinsic transistor means coupled to the current mirror means, the intrinsic transistor means including a first plurality of transistors, each of the first plurality of transistors being substantially the same size; and threshold voltage means coupled to the intrinsic transistor means, the threshold voltage means including a second plurality of transistors, each of the second plurality of transistors being substantially the same size, wherein the reference voltage circuit provides a reference output voltage which is substantially insensitive to temperature and process variations.

2. The reference voltage circuit of claim 1 in which the intrinsic transistor means comprises:

a first intrinsic transistor coupled to the first transistor;

a second intrinsic transistor coupled to the first intrinsic transistor and the second transistor; and a second resistance coupled to the first intrinsic transistor.

3. The reference voltage circuit of claim 2 in which the voltage threshold means comprises:

a first voltage threshold transistor coupled between the second resistance and ground potential; and a second voltage threshold transistor coupled between the second intrinsic transistor and the ground potential.

4. A reference voltage circuit comprising:

a current mirror circuit means coupled to a voltage source;

the current mirror circuit means further including a first transistor coupled to the voltage source, a second transistor coupled to the first transistor and the voltage source, a third transistor coupled to the first transistor, the second transistor and the voltage source, and a first resistance coupled between the third transistor and the ground potential;

intrinsic transistor means coupled to the current mirror means, and threshold voltage means coupled to the intrinsic transistor means and coupled to a ground potential, wherein the reference voltage circuit provides a reference voltage which is substantially insensitive to temperature and process variations.

5. The reference voltage circuit of claim 4 in which the intrinsic transistor means comprising:

a first intrinsic transistor coupled to the first transistor;

a second intrinsic transistor coupled to the first intrinsic transistor and the second transistor, the first and second intrinsic transistors being substantially the same size; and a second resistance coupled to the first intrinsic transistor.

6. The reference voltage circuit of claim 5 in which the voltage threshold means comprises:

a first voltage threshold transistor coupled between the second resistance and the ground potential; and a second voltage threshold transistor coupled between the second intrinsic transistor and the ground potential; the first and second voltage threshold transistors being substantially the same size.

7. The reference voltage circuit of claim 6 in which the first, second and third transistors being P-MOS transistors.

8. A reference voltage circuit comprising;

a current mirror circuit means coupled to a voltage source, the current mirror means comprising a first transistor coupled to the voltage source, a second transistor coupled to the first transistor and the voltage source, a third transistor coupled the first transistor, the second transistor and the voltage source, and a first resistance coupled between the third transistor and a ground potential;

intrinsic transistor means coupled to the current mirror means, the intrinsic transistor means comprising a first intrinsic transistor coupled to the first transistor, a second intrinsic transistor coupled to the first intrinsic transistor and the second transistor, the first and second intrinsic transistors being substantially the same size, and a second resistance coupled to the first intrinsic transistor; and threshold voltage means coupled to the intrinsic transistor means and coupled to a ground potential, the threshold voltage means comprises a first voltage threshold transistor coupled between the second resistance and the ground potential, and a second voltage threshold transistor coupled between the second intrinsic transistor and the ground potential, the first and second voltage threshold transistors being substantially the same size, wherein the reference voltage circuit provides a reference voltage which is substantially insensitive to temperature and process variations.

9. The reference voltage circuit of claim 8 in which the first, second and third transistors being P-MOS transistors.

* * * * *